US006290554B1

(12) United States Patent
Makita et al.

(10) Patent No.: US 6,290,554 B1
(45) Date of Patent: Sep. 18, 2001

(54) FEMALE TERMINAL FITTING AND A FEMALE CONNECTOR

(75) Inventors: Yasumitsu Makita; Yukihiro Fukatsu, both of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/526,304

(22) Filed: Mar. 15, 2000

(30) Foreign Application Priority Data

Mar. 16, 1999 (JP) ..... 11-069998

(51) Int. Cl.[7] ..... H01R 11/22; H01R 13/11

(52) U.S. Cl. ..... 439/852

(58) Field of Search ..... 439/850, 851, 439/852, 464

(56) References Cited

U.S. PATENT DOCUMENTS 4,690,478 * 9/1987 Rahrig et al. ..... 439/271
4,717,356 * 1/1988 Rahrig et al. ..... 439/464
5,540,603 * 7/1996 Fujiwara ..... 439/851
5,601,458 * 2/1997 Ohsumi et al. ..... 439/852
5,607,328 * 3/1997 Joly ..... 439/852
5,788,542 * 8/1998 Miwa ..... 439/851
5,833,500 * 11/1998 Mahon et al. ..... 439/852
5,839,925 * 11/1998 Simmons ..... 439/852

FOREIGN PATENT DOCUMENTS 10-134875 5/1998 (JP) .

* cited by examiner

*Primary Examiner*—Paula Bradley
*Assistant Examiner*—James Harvey
(74) *Attorney, Agent, or Firm*—Anthony J. Casella; Gerald E. Hespos

(57) ABSTRACT

A female terminal fitting is provided to prevent a waterproof rubber plug from being damaged. The female terminal fitting has an opening 21 formed in the leading end of a box-shaped main portion 20 having angular portions at its four corners. Side wall extending pieces 40 and an upper wall extending piece 44 extending forward from side walls 26 and a ceiling plate 32*a* are turned inside at the opening 21. Thus rounded side edges 42 and an upper edge of the opening 21 are formed by the turned portions of the extending pieces 40, 44. Since the extending pieces 40, 44 are turned not at their bottom ends, but at their intermediate positions, four corner portions 43 at the leading ends of the angular portions 28 are retracted.

6 Claims, 7 Drawing Sheets

FEMALE TERMINAL FITTING AND A FEMALE CONNECTOR

BACKGROUND OF THE INVENTION

1. Field of the Invention

The present invention relates to a female terminal fitting, and more particularly to a box-shaped female terminal fitting that can be inserted into a waterproof rubber plug. The invention also relates to a female connector comprising one or more of such female terminal fittings.

2. Description of the Related Art

A prior art female terminal fitting that can be inserted into a waterproof rubber plug is disclosed in Japanese Unexamined Patent Publication 10-134875, and also is illustrated in FIG. 7 of this application. The prior art female terminal fitting is identified generally by the numeral 1 in FIG. 7, and is formed by bending a metal plate to define a box-shaped main portion 2 at its front and a barrel portion 3 at its rear for crimped connection to a wire. An opening is made in the leading end of the main portion 2, and a mating male terminal fitting can be inserted into the opening from the front for electrical connection with the female terminal fitting. The female terminal fitting 1 can be inserted into one of a plurality of cavities formed in a connector housing. A waterproof plug is provided at the rear end of the connector housing for collectively protecting a plurality of the wires from water. The female terminal fitting 1 is inserted in an insertion hole formed in the waterproof rubber plug from the front end of the main portion 2.

As noted above, the female terminal fitting 1 is formed by bending a stamped metal plate. Thus a sharp edge 5 is exposed at the opening 4 of the main portion 2. The sharp edge 5 may damage or tear the wall of the insertion hole when the main portion 2 of the female terminal fitting 1 is inserted into the insertion hole of the waterproof rubber plug. Such damage or tearing may reduce the ability of the rubber plug to seal the interface of the wires and the connector housing. Further, the box-shaped main portion 2 has four corners 6, and the vertices 7 of the corners 6 may damage or tear the inner surface of the insertion hole.

The present invention was developed in view of the above problem, and an object of the invention is to provide an improved female terminal fitting having substantially no sharp edges.

A further object of the invention is to prevent a waterproof rubber plug from being damaged during assembly of a female connector.

Still another object of the invention is to provide a female connector comprising one or more of such female terminal fittings.

SUMMARY OF THE INVENTION

The subject invention is directed to a female terminal fitting with a leading end and a main portion extending rearward from the leading end. An opening extends into the leading end of the main portion, and is configured to receive a mating male terminal fitting. The opening has an edge that is rounded by turning inwardly extending pieces formed at the leading end of the main portion. Thus, no sharp edge is exposed at the front end, and hence the female terminal fitting is not likely to damage a waterproof rubber plug during insertion of the female terminal fitting into an insertion hole of the waterproof rubber plug.

Leading ends of angular portions at corners of the main portion may be retracted from the edge of the opening. Thus the rounded edge of the opening at the leading end of the main body widens the insertion hole as the main portion enters the insertion hole of the waterproof rubber plug. The retracted angular portions then pass through the insertion hole after the widening by the edge of the opening. Accordingly, the interference of the leading ends of the angular portions with the inner surface of the insertion hole can be avoided to the utmost, thereby further preventing damage to the inner surface.

The terminal fitting may be formed by bending a metal plate along bend lines. More particularly, the main portion may be formed by bending side plates at the opposite side edges of a bottom plate and bending ceiling plates inwardly. The ceiling plates may be dimensioned such that side portions of the ceiling plates are placed at least partially one over the other.

At least one projection may be provided on a side surface of the main portion for preventing an upside-down insertion of the female terminal fitting into a cavity of a connector housing. The projection may have a bridge-shape extending along longitudinal direction of the main portion.

The front end of the projection may have a sufficiently large width so as not to be pointed or sharp. Preferably, the projection has a lateral width between 20% and 90% of the total width of the main portion. Accordingly, when the terminal fitting is inserted into a waterproof plug, such as a waterproof rubber plug, the projection does not cut into or damage the opening of the waterproof plug.

The main portion may comprise a tongue that is bent inwardly for coming into contact with a contact portion of the male terminal fitting. The tongue preferably is substantially U-turned inwardly on the main portion and is shaped to have a triangular cross section along a fitting direction of the female terminal fitting. One or more restricting pieces preferably are provided on sidewalls of the main portion to prevent the tongue from being struck by external matter.

The front end of the tongue may be retracted with respect to the front end of the main portion.

Most preferably, the edges of all sidewalls are rounded except for the sidewall on which the tongue is formed.

According to the invention, there is further provided a female connector having one or more cavities for at least partly accommodating one or more resilient plugs. One or more female terminal fittings as described above can be inserted are at least partly into corresponding insertion holes in the resilient plugs.

These and other objects, features and advantages of the present invention will become more apparent upon a reading of the following detailed description and accompanying drawings.

DETAILED DESCRIPTION OF THE PREFERRED EMBODIMENT

Figure 1:
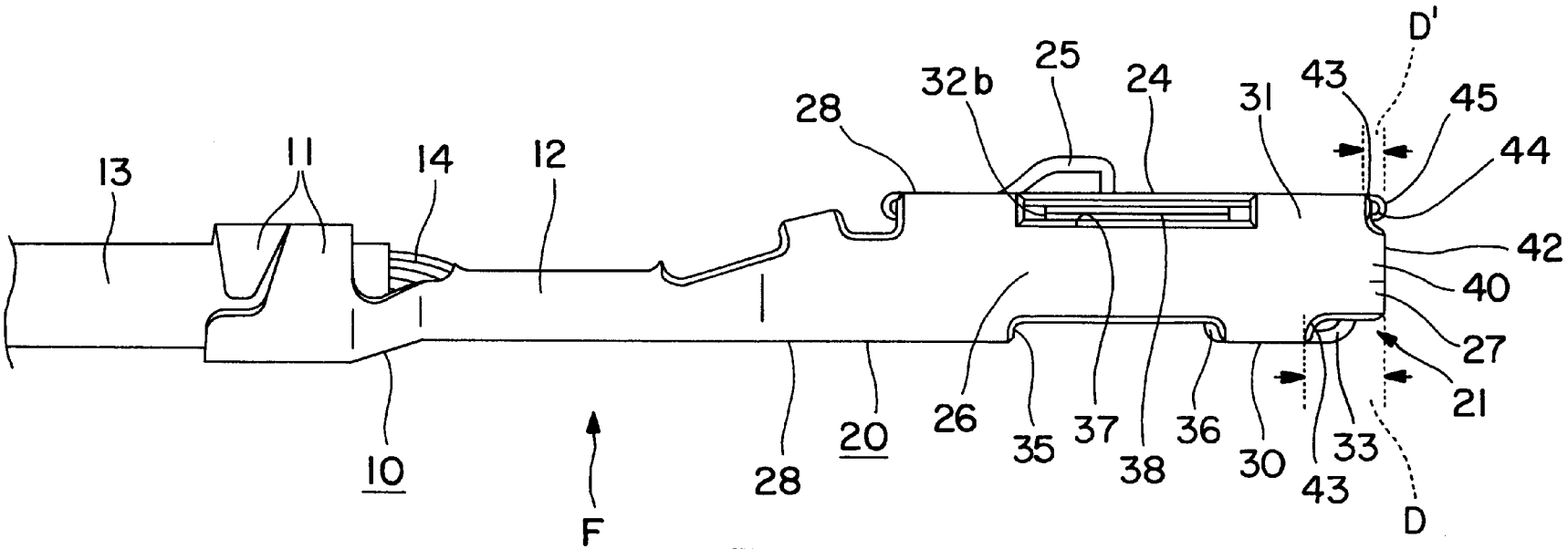
FIG. 1 is a side view of a female terminal fitting according to one embodiment of the invention.
Figure 2:
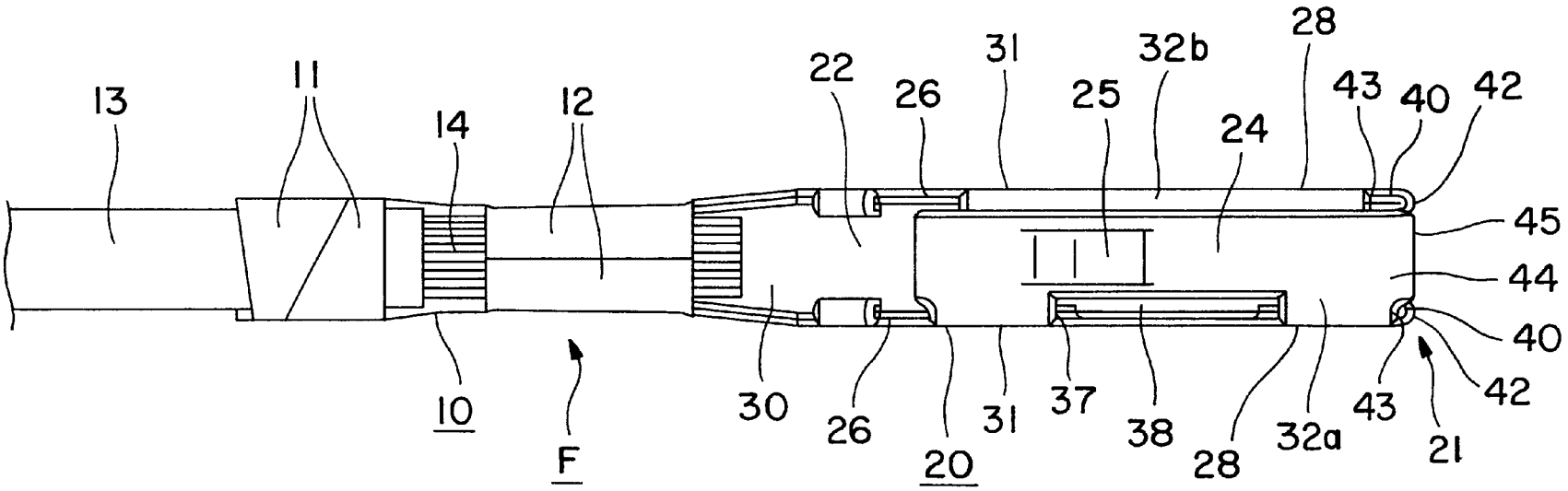
FIG. 2 is a plan view of the female terminal fitting.
Figure 3:
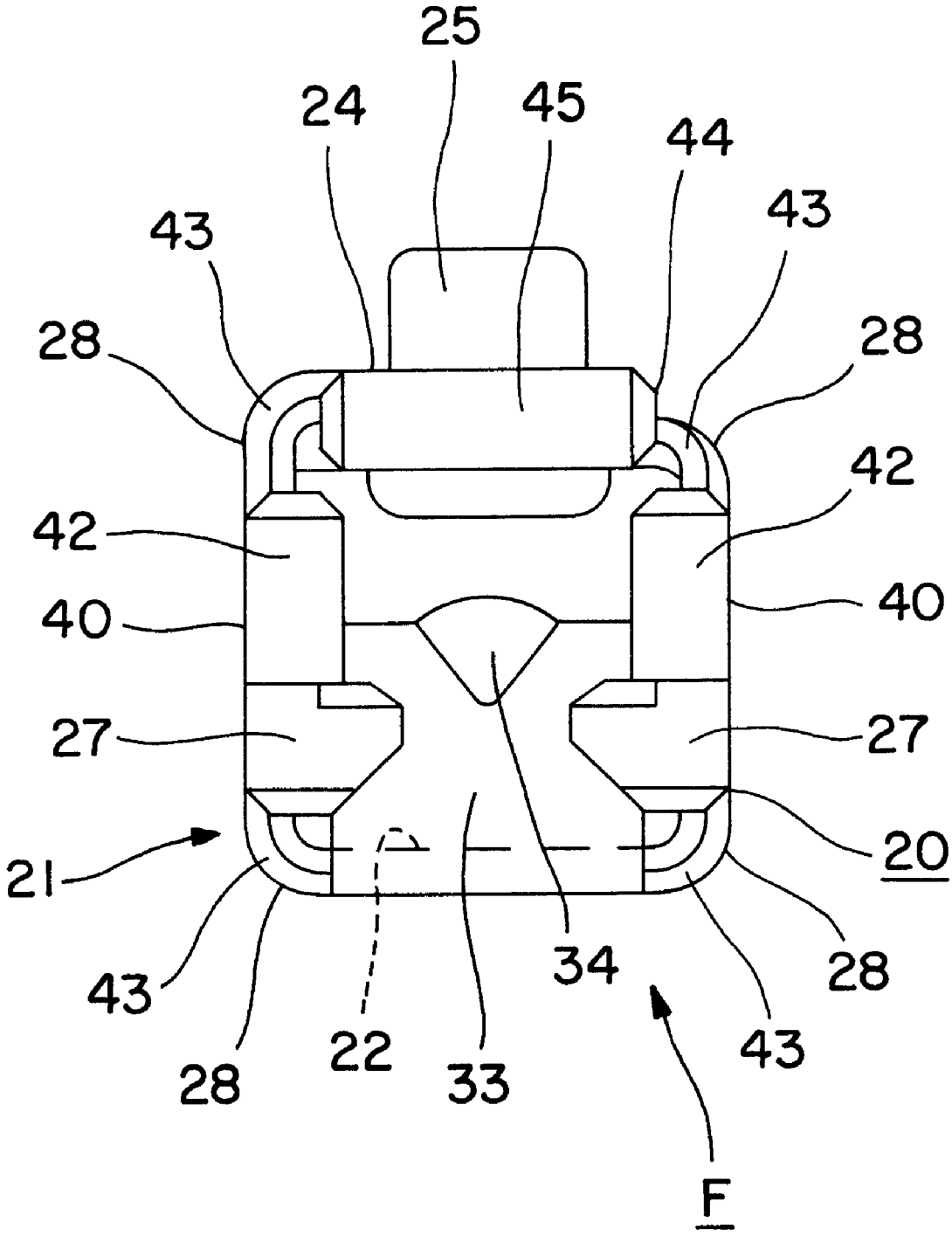
FIG. 3 is a front view of the female terminal fitting.
Figure 4:
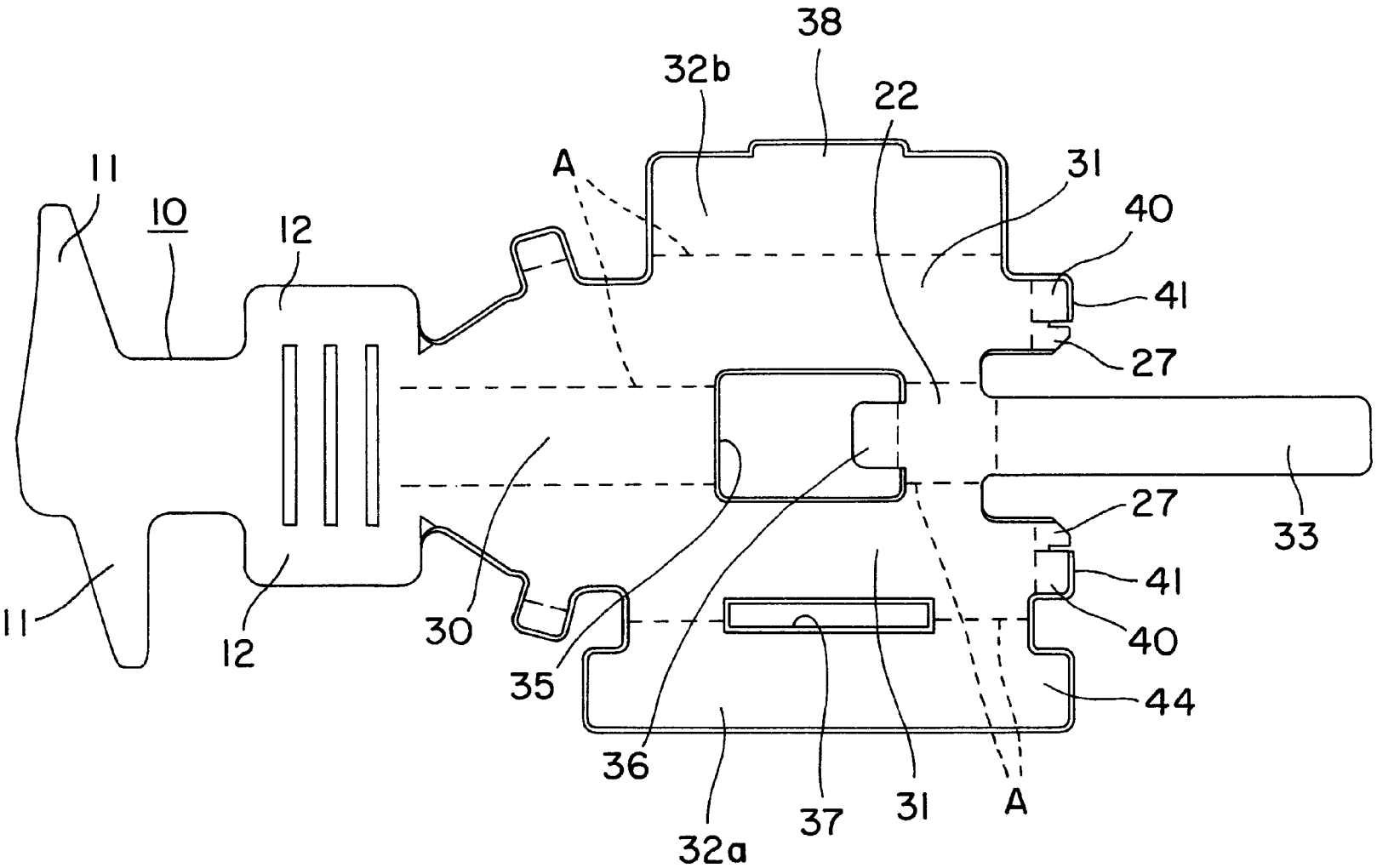
FIG. 4 is a plan view showing a development of the female terminal fitting.
Figure 5:
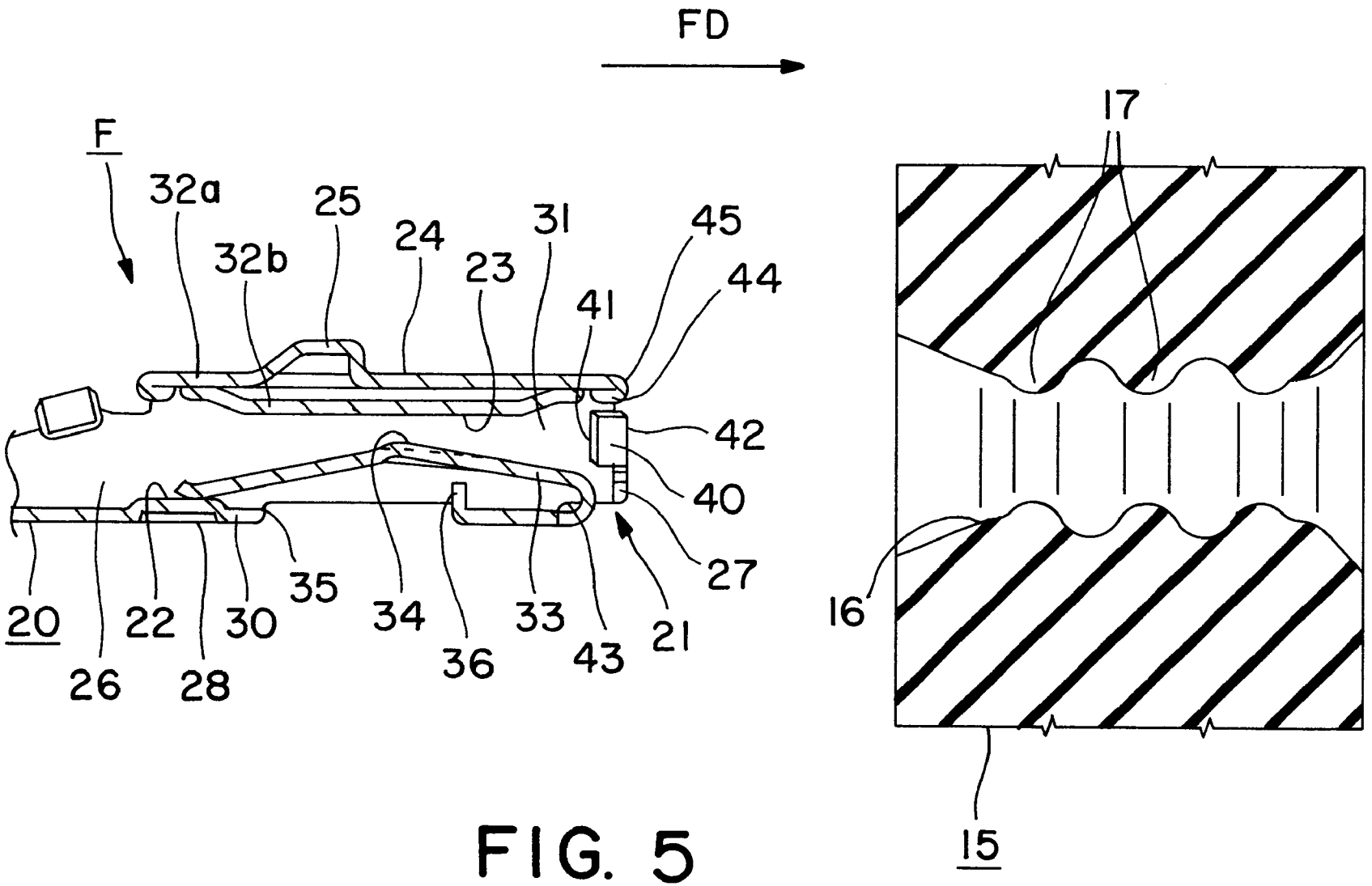
FIG. 5 is a side view in section showing the female terminal fitting and a waterproof rubber plug.

A female terminal fitting in accordance with the subject invention is identified by the letter F in FIGS. 1 to 6, and is intended for insertion into a one-piece waterproof rubber plug. The female terminal fitting F has a substantially box-shaped main portion 20 at its front end and a barrel portion 10 at its rear end. The box-shaped main portion is formed with angular portions 28 at its corners. The barrel portion 10, on the other hand, is configured for fastening to an end of a wire 13 that has had its core 14 exposed, as shown in FIGS. 1 to 3. The female terminal fitting F is to be inserted into an insertion hole 16 of a waterproof sealing or rubber plug 15 from the leading end of the main portion 20, as illustrated in FIG. 5 and as described further herein.

Figure 6:
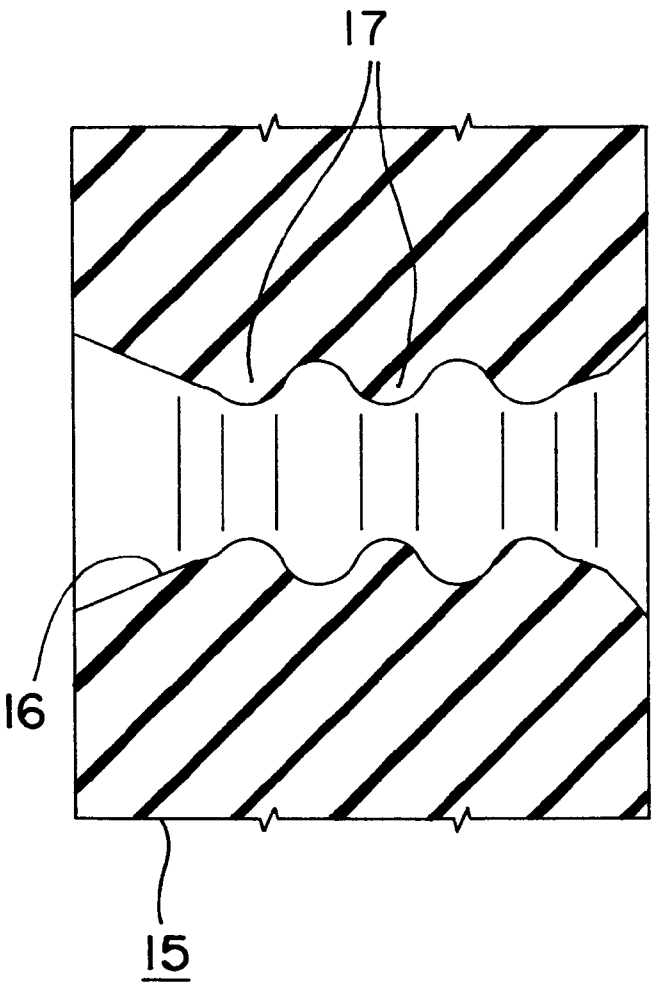
FIG. 6 is a plan view in section showing the female terminal fitting and the waterproof rubber plug.
Figure 6:
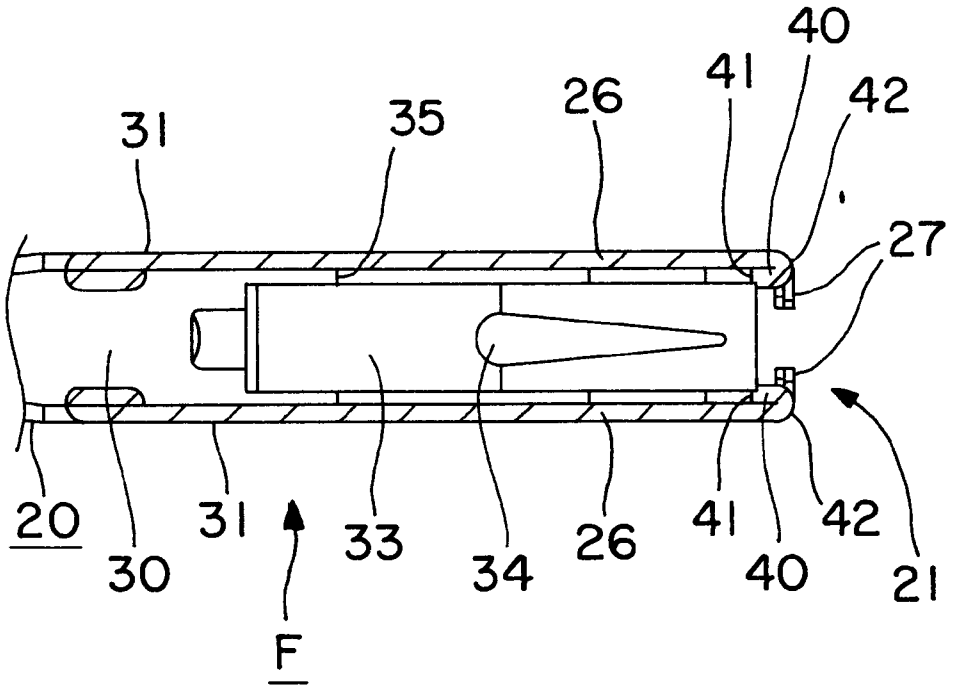
Figure 7:
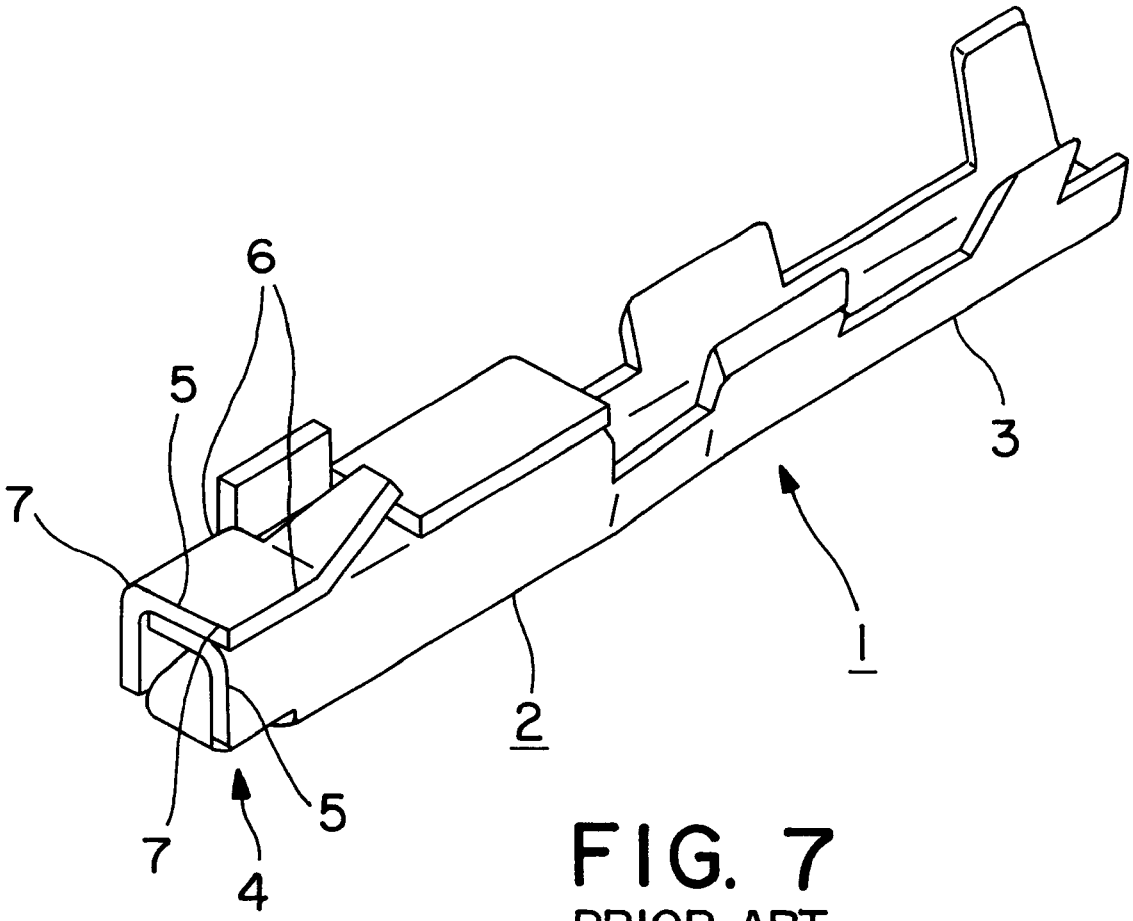
FIG. 7 PRIOR ART
FIG. 7 is a perspective view of a prior art female terminal fitting.

The waterproof rubber plug 15 through which the female terminal fitting F is inserted is mounted on a female water-tight connector preferably to protect a plurality of wires 13 from water. The waterproof rubber plug is formed with a plurality of insertion holes 16 into which the female terminal fittings F and the wires 13 can be inserted, as shown in FIGS. 5 and 6. Lips or projections 17 are formed bulgingly on the inner surface of each insertion hole to extend over its entire circumference. The inner diameter of the lips 17 is substantially smaller than the outer diameter of the wire 13 so that the lips 17 can hold the wire 13 in substantially close contact therewith.

The female terminal fitting F is formed, for example, by stamping out an electrically conductive metal plate to have a development as shown in FIG. 4, and then bending the stamped-out metal plate along dotted lines A of FIG. 4 by pressing.

The barrel portion 10 is such that a wire barrel 12 to be fastened to the core 14 and an insulation barrel 11 to be fastened to an insulation coating are formed one after another or adjacent to each other as shown in FIGS. 1 to 3.

The main portion 20 is formed to have a substantially box-shape by bending side plates 31 at the dotted lines A of FIG. 4 at the opposite side edges of a bottom plate 30, and by bending ceiling plates 32*a*, 32*b* inwardly at the dotted lines A at the top of the side plates 31. The ceiling plates 32*a*, 32*b* are dimensioned to be placed substantially one over the other. An opening 21 for receiving a male terminal fitting is formed at the front end of the main portion 20.

The front end of the bottom plate 30 forms a bottom surface 22 of the main portion 20 that extends longitudinally, as shown in the development of the FIG. 4, and serves as a tongue 33 which can come into contact with the male terminal fitting. More specifically, this extended long piece is preferably substantially U-turned inwardly of the main portion 20, and is shaped to have a substantially upward pointing substantially triangular cross section along a fitting direction FD of the female terminal fitting as shown in FIG. 5. The tongue 33 is substantially elastically deformable laterally or upward and downward. Additionally, its rear end is substantially elastically in contact with the bottom surface 22 of the main portion 20 and slides backward as the male terminal fitting is inserted. The tongue 33 elastically holds the male terminal fitting in cooperation with the ceiling surface 23 of the main portion 20, and establishes an electrical connection of the female terminal fitting F with the (unillustrated) male terminal fitting by a contact portion 34 formed substantially at the vertex of the tongue 33.

A locking hole 35 is open laterally or below the tongue 33 in the bottom surface 22 of the main portion 20. The locking hole 35 can be engaged with a locking portion formed in the cavity of the connector housing for accommodating the female terminal fitting F and to lock the female terminal fitting F in the cavity. A front end 36 of the locking hole 35 projects inwardly and restricts excessive deformation of the tongue 33.

A projection 25 is provided in an upper surface 24 of the main portion 20 slightly backward from its center for preventing an upside-down insertion of the female terminal fitting F into the cavity of the connector housing. The projection 25 is formed, for example, by making a cut in the outer ceiling plate 32*a* of the ceiling of the main portion 20. The cut portion then is bent into a protrusion that preferably defines a bridge-shape extending along longitudinal or forward and backward directions and projecting sideways or upward. The bridge-shape ensures that no sharp edge will be formed at the front end of the projection 25.

The front end of the side plates 31 that form the opposite sidewalls 26 of the main portion 20 project forward as shown in the development of FIG. 4. Each projecting portion is separated into a sidewall extending piece 40 and a restricting piece 27 by a cut made therein from its front edge. The restricting pieces 27 are bent at an angle different from 0° or 180°, preferably substantially at a right angle to the corresponding side walls 26 of the main portion 20 and face each other while defining a small clearance therebetween in front of the turned portion of the tongue 33, as shown in FIG. 3. Thus, the restricting pieces 27 prevent the tongue 33 from being struck by external matter.

The sidewall extending pieces 40 are turned to be in close contact with the inner surfaces of the sidewalls 26, as shown in FIG. 6. Accordingly, front edges 41 of the sidewall extending pieces 40, which could be sharp edges, are located inside the main portion 20. Round edges, on the other hand, are present at the left and right ends 42 of the opening 21. It should be noted that the sidewall extending pieces 40 are turned not at their bottom ends, but at their intermediate positions. Thus, the corners of the opening 21 of the main portion 20, i.e. four corner portions 43 at the leading end of the angular portions 28, are retracted or indented or recessed. Accordingly, the angular portions 28 are spaced by a distance D or D' (FIG. 1) from the front edge portion of the female terminal fitting F along a longitudinal direction of the main portion 20 or a fitting direction of the female terminal fitting F into the waterproof rubber plug 15.

As described above, the ceiling of the main portion 20 preferably is formed by at least partially placing the two ceiling plates substantially one over the other. As shown in the development of the FIG. 4, a slit 37 extends in longitudinal or forward and backward directions between the outer ceiling plate 32*a* and the side plate 31 adjacent thereto. A projecting edge 38 is formed substantially in the middle of a side edge of the inner ceiling plate 32*b* and can be inserted into the slit 37. The main portion 20 is assembled by inserting the projecting edge 38 into the slit 37. Further, an upper wall extending piece 44 projects at the front end of the outer ceiling plate 32*a*. Similar to the side wall extending pieces 40, the upper wall extending piece 44 is turned at its intermediate position, and is in substantially close contact with the ceiling surface of the main portion 20, as shown in FIG. 5. In this way, an upper edge 45 and the opposite side edges 42 of the opening 21 are rounded, and the four corner portions 43 all are retracted or indented or recessed.

The front end of the inner ceiling plate 32*b* is shorter than the outer ceiling plate 32*a* by a distance corresponding to the length of the turned portion of the upper wall extending piece 44.

As described above, the opposite side edges 42 and the upper edge 45 of the opening 21 all are rounded and the four corner portions 43 are retracted. Thus the female terminal fitting F does not damage the waterproof rubber plug 15 during insertion into the insertion hole 16 of the waterproof rubber plug 15. Further, the projection 25 has a bridge-shape, and no sharp edge is present at the front surface. Therefore the projection 25 also will not damage the waterproof rubber plug 15.

The present invention is not limited to the above described and illustrated embodiment. For example, the following embodiment also is embraced by the technical scope of the invention as defined in the claims. Besides, a variety of changes can be made without departing from the scope and spirit of the invention as defined in the claims.

Although the female terminal fitting is fastened to the wire by the barrel portion in the foregoing embodiment, the present invention is also applicable to a female terminal fitting having an insulation displacing blade portion into which the wire is pressed for the connection.

What is claimed is:

1. A female terminal fitting having a front end and an opposite rear end, said terminal fitting comprising a main portion formed at the front end of the terminal fitting, the main portion being of substantially rectangular cross-section and having a top wall, a bottom wall and opposed first and second side walls extending between the top and bottom walls, the walls intersecting at corners, the main portion further being formed with an opening into which a mating male terminal fitting can be inserted, portions of the opening defined by the side walls having edges that are rounded by turning extending pieces of the side walls extending from the leading end of the main portion inside, a tongue extending unitarily from the bottom wall and bent inwardly between bent portions of the side wall for contacting a contact portion of the male terminal fitting, the top wall of the main portion comprising an inner top wall extending unitarily from the first side wall substantially to the corner between an outer top wall and the second side wall and the outer top wall extending unitarily from the second side wall substantially to the corner between the inner top wall and the first side wall, the outer top wall having an extending piece extending forwardly beyond the inner top wall and being folded 180 degrees inwardly into substantially face-to-face relationship with the inner top wall for maintaining said rectangular cross-section of said main portion, the corners of the main portion being retracted from the front end of the terminal fitting, whereby the front end of the terminal fitting is defined entirely by rounded edges formed by the inwardly folded extending pieces of the side walls and the top wall, and whereby longitudinal edges of the inner and outer top walls are disposed in said retracted corners between said top wall and said side walls for facilitating insertion of said female terminal fitting through a sealing member.

2. A female terminal fitting according to claim 1, wherein at least one projection is provided on a side surface of the main portion for preventing an upside-down insertion of the female terminal fitting into a cavity of a connector housing.

3. A female terminal fitting according to claim 2, wherein the projection has a bridge-shape extending along a longitudinal direction of the main portion.

4. A female terminal fitting according to claim 1, wherein the tongue is substantially a U-turned inwardly of the main portion and being shaped to have a triangular cross section along a fitting direction of the female terminal fitting.

5. A female terminal fitting according to claim 4, wherein restricting pieces are provided on the side walls of the main portion at locations between the bent extending pieces of the side walls and the retracted corners between the side walls and the bottom wall to guide the male terminal fitting into the main portion and to prevent the tongue from being struck by external matter.

6. A female terminal fitting according to claim 5, wherein the front end of the tongue is retracted with respect to the front end of the main portion.

* * * * *